United States Patent [19]

Schmid et al.

[11] 4,094,040

[45] June 13, 1978

[54] HINGE

[75] Inventors: Günter Schmid, Freudenstadt-Dietersweiler; Christian Schaber, Lossburg, both of Germany

[73] Assignee: Hetal-Werke Franz Hettich KG., Alpirsbach, Germany

[21] Appl. No.: 692,552

[22] Filed: Jun. 3, 1976

[30] Foreign Application Priority Data

Jun. 3, 1975 Germany ..... 2524454

[51] Int. Cl.[2] ..... E05D 5/02

[52] U.S. Cl. ..... 16/191; 16/180; 16/190; 16/163

[58] Field of Search ..... 16/180, 182, 164, 190, 16/163, 145, 147, 139, 142, 166, 173, 183

[56] References Cited

U.S. PATENT DOCUMENTS

| | | | |
|---|---|---|---|
| 3,952,368 | 4/1976 | Zernig et al. | 16/163 |
| 3,977,043 | 8/1976 | Zernig | 16/137 |

*Primary Examiner*—Wayne L. Shedd

*Attorney, Agent, or Firm*—Watson, Cole, Grindle & Watson

[57] ABSTRACT

A hinge is provided for mounting a frameless glass door or the like on a fixture. The hinge includes a part-cylindrical body portion adapted to be inserted in an opening in the door, the cross-section of the opening being defined by a chord which provides a planar portion on the cylindrical surface of the body portion. This planar portion, when the hinge is assembled, is aligned with a longitudinal edge of the door. A pin of the hinge extends parallel to the body portion and is spaced therefrom, the pin being adapted for insertion in a bore provided in the door. A connecting member hingedly connected to the body portion is adapted for mounting the hinge on the fixture.

20 Claims, 20 Drawing Figures

HINGE

This invention relates to a hinge, particularly a hinge for use with frameless glass doors or the like.

With a known hinge of the type having a cylindrical body suitable for insertion into a recess in the door or the like and provided with a connecting element which is removably fastened to the fixture, the cylindrical body is inserted into a hole which has a corresponding diameter and which is drilled through the glass pane of the door, at a suitable spacing from the longitudinal edge thereof adjacent the fixture. Since both the hinge body and the hole in which it is accommodated have a circular cross-section, the door is in danger of sagging to an extent which depends on the angle through which the hinge body can rotate inside the hole. In order to avoid this serious drawback it has been necessary to resort to remedies as cumbersome as they are expensive.

With other known forms of this type of hinge, the body comprises an approximately rectangular projection which is either directly adjacent to the hinge body on the side facing, in the assembled position, the longitudinal edge of the door adjacent the structure, or is located at a given spacing between it and the body, so as to align with the longitudinal edge on the outside. To incorporate a hinge of this type into a preferably frameless glass door or the like, a recess has to be provided which consists of a circular bore and a rectangular section. Although in this manner the door is prevented from sagging, this can only be achieved at the expense of a relatively complex operation; when cutting this recess in the door or the like it is not only necessary to drill holes but to produce at least two cuts with the saw. This is relatively expensive, especially in the case of all-glass doors.

It is an object of the present invention to provide a hinge especially for frameless glass doors or the like, which obviate or mitigate the possibility of vertical displacements of the door relative to a fixed frame structure.

According to the present invention there is provided a hinge for mounting a structure such as a frameless glass door or the like on a fixture, said hinge comprising a substantially part-cylindrical body portion which is arranged to be inserted in an opening in the structure, and the cross-section of which is defined by a chord so as to provide, on the cylindrical surface of the body portion, a planar portion, the latter, when the hinge is assembled on the structure, being aligned with a longitudinal edge of the structure, a pin which extends parallel to the body portion and is spaced therefrom such that its axis lies on an imaginary line which passes through the axis of the body portion normal to said chord, to the side of the axis of the body portion remote from said chord, said pin being arranged to be inserted in a bore in the structure, and a connecting member hinged on the body portion and adapted to be mounted on the fixture.

In this manner not only the manufacture of the hinge according to the invention is simplified but also the means which have to be applied in order to mount the door or the like are simple, since all that is required is that two openings or holes are drilled through the door or the like, and this can be done in one single operation. The pin prevents the glass door or the like from sagging. Moreover, since the planar portion aligns with the longitudinal edge of the door or the like, there is no narrow web which might fracture between the longitudinal edge and the drilled hole accommodating the hinge body.

According to the present invention there is also provided a hinge for mounting a structure on a fixture, comprising a first member for mounting on the structure, a connecting member hinged on said first member and adapted to be mounted on the fixture, and an arresting member rotatably mounted on said first member and engageable with a locking portion of said connecting member to retain the latter in one position relative to said first member, said arresting member being biased into a position for locking engagement with said locking portion, and being located on said first member between two parts which provide a bearing for a pin on which the arresting member is mounted.

Theoretically it would seem feasible to flatten the body portion so much that its cross-section is reduced to a semi-cylindrical form. In practice, however, this would not be an advantage since it would be difficult to fit the door with a device to keep it open or closed. Bearing in mind this possible need, the body portion is effectively flattened in such a manner that the height of the effectively removed segment defined by the chord amounts to approximately one third or a quarter of the body diameter. This enables an arresting device to be fitted to the body portion, which keeps the door open or closed, and avoids, at the same time, sharp glass corners and consequently the danger of their breakage. It is an additional advantage that the circumference of the opening for the body portion encircles the latter sufficiently to ensure that the tension created in the zone of the drilled opening between the body portion and the door does not have to be absorbed by the pin alone.

Embodiments of the present invention will now be described, by way of example only, with reference to the accompanying drawings, in which.

Figure 14:
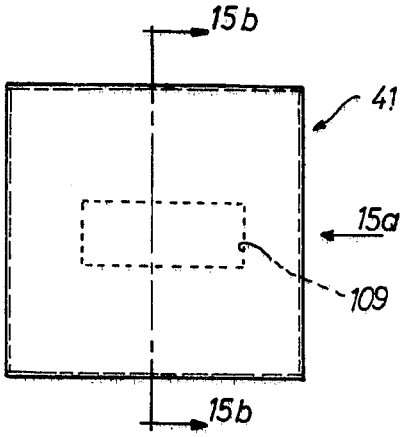
FIG. 14 shows a first embodiment of a cover element.
Figure 15A:
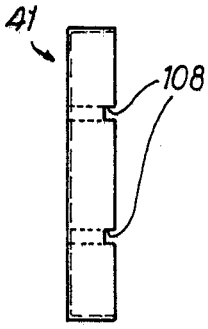
Figure 15B:
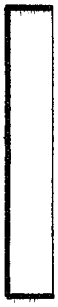
Figure 16:
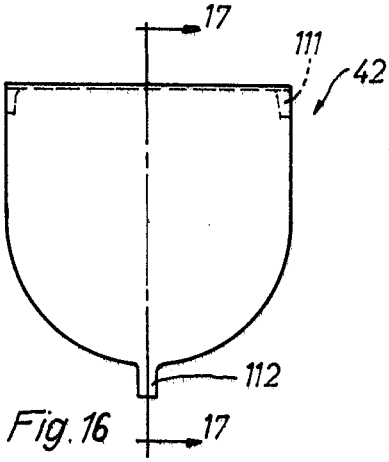
Figure 17:
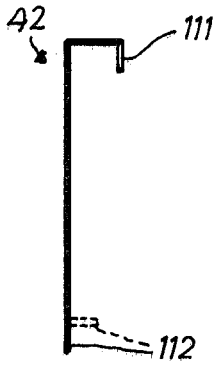
Figure 18:
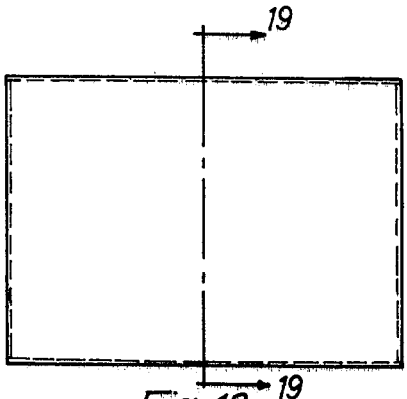

FIG. **15*a* is a view in the direction of the arrow 15*a* in FIG. 14**;

FIG. **15*b* is a section on the line 15*b*—15*b* in FIG. 14**;

FIG. 16 is a plan view of a second embodiment of a cover element;

FIG. 17 is a section along the line 17—17 in FIG. 16;

FIG. 18 is a plan view of a third embodiment of a cover element; and

Figure 19:
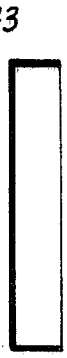

FIG. 19 is a section on the line 19—19 in FIG. 18.

Figure 1:
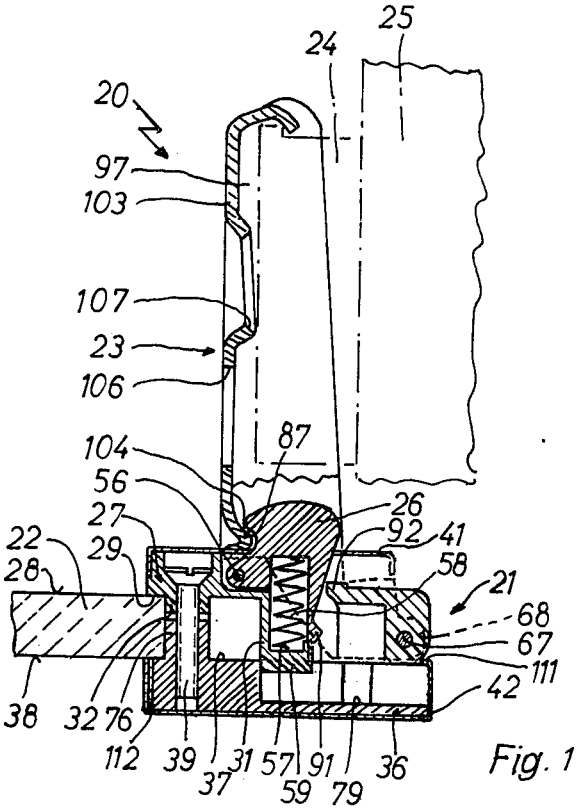
FIG. 1 is a longitudinal section through a hinge fitted into a glass door, showing the hinge in one end position with the connecting member engaged therewith.
Figure 2:
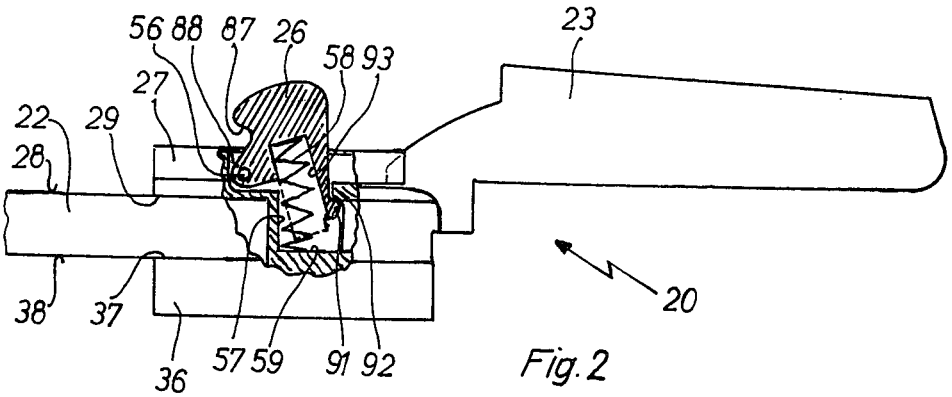
FIG. 2 shows a hinge according to FIG. 1 in elevation, partly exposed, but in its other end position.

FIGS. 1 and 2 depict, in a preferred embodiment of the invention, a hinge 20 already built into a glass door 22, the Figures showing the hinge in its two respective end positions. The hinge 20 comprises a movable part 21 fitted into the glass door 22 in the region of a longitudinal edge 46 thereof and a connecting member 23 which is rotatable through an angle of 90° on the movable part 21 of the hinge. The connecting member 23 is fastened, for example, by means of screws, to a fixed part 24 of the hinge as indicated in the Figure by the trace of chain-dotted lines, the part 24 being fixed to a fixture 25, for example a wall, a frame, or the like, shown in chain-dotted lines.

With the movable part 21 of the hinge in the position shown in FIG. 1, the door is kept either open or closed depending on whether the fixture, e.g. the wall or frame which is located opposite the fixture 25, extends parallel to the fixture 25 or is end-to-end in the plane of the fixture 25, and correspondingly it is kept respectively closed or open when the movable part 21 of the hinge is in the position as shown in FIG. 2. In the arrangement shown in FIG. 1 where the movable part 21 of the hinge extends at right angles to the connecting member 23, the latter engages with an arresting member 26 pivoted on the movable part 21 of the hinge, so that pressure has to be overcome when moving the hinge 20, or rather the door 22, into the position shown in FIG. 2, which means that the arresting member enables the door to be kept open or closed as required.

The movable part 21 of the hinge which, with the exception of the metallic connecting member 23, is formed of a plastics material, comprises a shaped part 27, having a plane underside 29 resting against one of the outer faces 28 of the door 22, a part-cylindrical body 31, and a cylindrical pin 32 projecting from the underside 29 and respectively engaging, in the assembled position, with corresponding drilled holes 33 and 34 in the glass pane of the door 22. The movable part 21 of the hinge is moreover provided with a cover plate 36, a plane underside 37 of which rests against the other outer face 38 of the door 22. The shaped part 27 and the cover plate 36 are firmly connected by means of screws 39 which extend through bores 72 and 73, respectively located in body 31 and pin 32 which respectively engage bores 33, 34 in the door 22, thereby clamping between them the glass pane of the door 22. As shown in FIG. 1, the shaped part 27 and the cover plate 36 are encased by covers 41 and 42 each of which is made of metal and has a plane outer surface.

FIGS. 3 to 18 present details of the elements used with the hinge 20, and the section of the glass door 22 into which the hinge is fitted.

Figure 3:
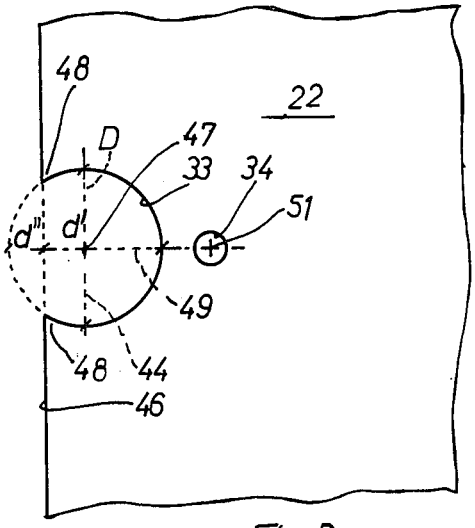
FIG. 3 shows the cut-out in a glass door, in the region where the hinge is to be fitted.

As shown in FIG. 3, a hole 33 is drilled through the door 22 wherever a movable hinge part 21 has to be accommodated, whereby the longitudinal edge 46 of the pane of glass, which is adjacent to the fixture 25, intersects the bore 33 at a given distance $d'$ from the bore-centre 47. In other words, the bore outline lies outwardly of edge 46 a distance $d''$ as indicated by the broken lines. In other words, the longitudinal edge defines a chord which cuts off as a secant, a segment of height $d''$. The distance $d'$, i.e. D-d'', is approximately equal to three quarters of the diameter D of the bore 33. So as to avoid sharp corners 48 at the points of intersection between the longitudinal edge 46 and the inner circumference of the bore 33, the maximum length of $d'$ should be $\frac{3}{4}$ . D, (preferably between $\frac{3}{4}$D and $\frac{1}{3}$D) and the minimum length of $d''$ should consequently be $\frac{1}{4}$ . D. With the chosen embodiments, when $D = 26$ mm or 28 mm, and $d' = 19$ mm or 20 mm, respectively, the tolerance is +0.1 mm in all cases. The centre 51 of the hole 34 is located on an imaginary line which is defined by the projection of a diameter 49 which extends at right angles to the longitudinal edge 46 of the pane of glass. When deciding on the spacing between the two centres 47 and 51 one has to bear in mind that the portion of glass between the two circumferential regions which are closest to each other in the zone between the two holes 33 and 34 must be sufficiently large to prevent it from breaking out or similar damage. The two holes 33 and 34 in a glass door 22 can be drilled in a simple manner and, if required, in one single operation. It is evident that two or more of the pairs of holes 33, 34 can be cut out of a glass door 22 along its longitudinal edge 46. Generally it will be found sufficient to provide these bores and the corresponding hinges 20 in the upper, and in the bottom, zones of the door 22 but it is also feasible to drill additional holes in the middle section or any other position between the upper and the lower sections of the door 22, and to fit them with hinges.

FIGS. 6 to 11 show the shaped unit 27 with the part-cylindrical hinge body 31 and the cylindrical pin 32 which extends parallel to the hinge body 31.

The diameter of the hinge body 31 is such that the latter fits into the bore 33 with essentially no play. To match the form of the bore 33, the hinge body 31 is provided with a planar area 52 which, in the assembled position, aligns wth the longitudinal edge 46 of the door 22. The axial length of the hinge body 31 is greater than the thickness of the glass pane of the door 22, so that the body 31 projects (see FIG. 1) from the outer surface 38 of the door pane 22. The diameter of the cylindrical pin 32 corresponds to the diameter of the bore 34 in the door 22, so that the pin 32 may fit without play into its bore 34. The pin 32 is shorter than the thickness of the glass pane, the distance to which the pin projects into the bore 34 being preferably very short.

The shaped part 27, which connects the hinge body 31 with the pin 32 and maintains their relative spacing constant, comprises parallel projections 53 which extend (see FIGS. 6 and 11) from the upper surface, i.e. that surface remote from the hinge body and pin, while extending from the region of the pin 32 over half of the hinge body 31. The projections 53 are provided with bores 54 which align with each other and accommodate a swivel pin 56 for the arresting member or finger 26. A blind recess 57 in the shaped part 27, located between the projections 53 and on that side of the bores 54 which is remote from the pin 32, is accessible from the upper side, and extends into the hinge body 31, the blind recess 57 having a circular section on the side facing the transverse bores 54, and an approximately rectangular section adjacent thereto. The rectangular part accommodates one end of the arresting finger 26, and the circular part supports a compression spring 58 which is associated with the arresting finger 26 and rests against the base 59 of the blind recess 57. There are two parallel slots 61 in the shaped part 27 and the hinge body 31, each of which extends from the planar area 52 centrally through a respective one of the projections 53, to terminate in front of the bores 54 for the swivel pin 56. The height of these longitudinal slots 61 in their frontal region extending to the blind recess 57, is equal to the thickness of the shaped part 27 including the hinge body 31; in the adjacent section, they extend to the bottom 59 which merges into a curve 62 leading to the upper surface. In addition to this, the two longitudinal slots 61 comprise undercuts 63 with shoulders or bearing faces 64. In the region between the planar area 52 and the undercuts 63, the hinge body 31 comprises transverse bores 66 (FIGS. 6 and 7) which align with each other throughout the entire width of the body and into which a swivel pin 67 for the connecting member 23 can be inserted, to enable the latter to swivel through at least 90° in the longitudinal slots 61. At its free end, the hinge body 31 comprises approximately semi-circular recesses 71 which are located at either side of the longitudinal slots 61 and open into corresponding bores 72 (FIG. 11) which extend through the hinge body 31 and the shaped part 27, and have a chamfered upper end. Similarly a bore 73 of the cylindrical pin 32 extends through the shaped part 27.

Figure 4:
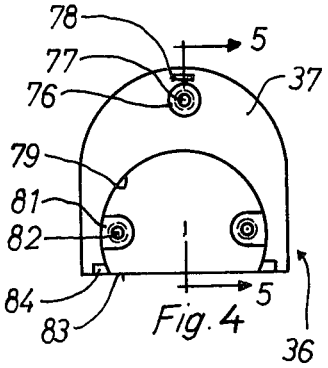
FIG. 4 is an underneath plan of a hinge cover plate.
Figure 5:
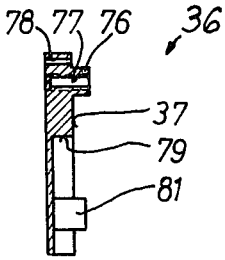
FIG. 5 is a section along the line 5—5 in FIG. 4.
Figure 6:
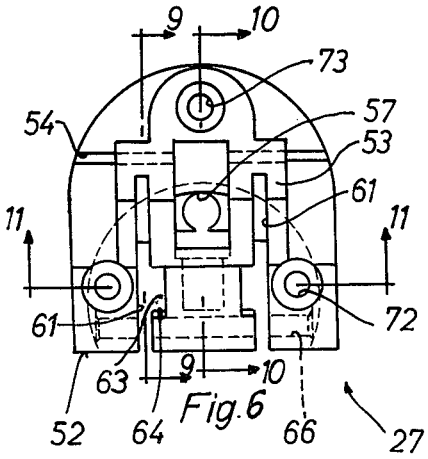
FIG. 6 is a plan view from above of a movable part of the hinge without the connecting member.
Figure 8:
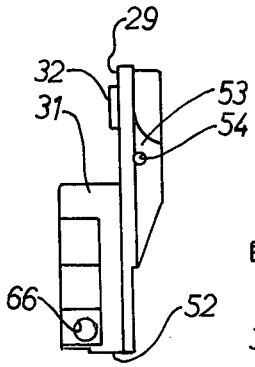
FIG. 8 shows the movable part of the hinge according to FIG. 6 in elevation.
Figure 11:
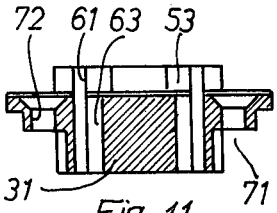
FIG. 11 is a transverse section along the line 11—11 in FIG. 6.
Figure 7:
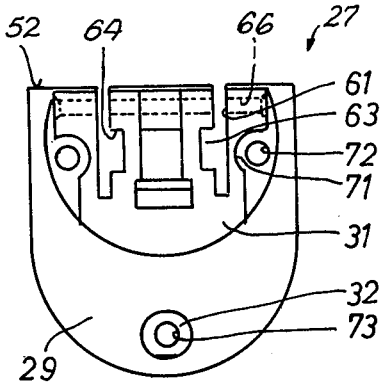
FIG. 7 is a plan view from below of the movable part of the hinge according to FIG. 6.
Figure 9:
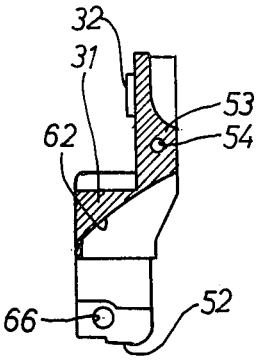
FIG. 9 is a longitudinal section along the line 9—9 in FIG. 6.
Figure 10:
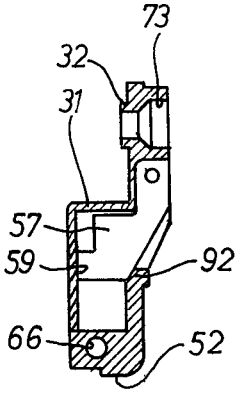
FIG. 10 is a longitudinal section along the line 10—10 in FIG. 6.

As shown in FIGS. 4 and 5, a circular projection 76 extends at right angles from a plane underside 37 of the covering plate 36, whose upper surface is likewise planar, this projection 76 comprising a blind bore 77 whose diameter is equal to the diameter of the bore 34 of the pin 32. A continuous, narrow, short slot 78 extends between the projection 76 and a semi-circular edge of the cover plate 36. The cover plate 36 moreover includes a large blind recess 79 whose diameter is equal to the diameter of the hinge body 31 and which has a similar planar face 83. The blind recess 79 has integral projections 81 adjacent to the inner circumference and comprising blind bores 82, which extend beyond the underside 37 of the cover plate 36. There are at either side of the blind-hole recess 79 small grooves 84 extending into the recess 79 from the face 83 which is aligned, in the assembled state, with the longitudinal edge 46 of the door 22.

When the cover plate 36 with the shaped part 27, the hinge body 31, and the pin 32, already inserted into the bores 33, 34, is mounted from the outer surface 38 of the door 22, the cylindrical projection 76 will fit into the bore 34 in the door 22, and consequently lie opposite to the cylindrical pin 32 of the shaped part 27. In addition, the end portion of the hinge body 31 which projects beyond the outer side of the door 22, engages with the blind-hole 79, the projections 81 extending into the recess 71 in the hinge body 31 so that their circular outer surfaces 86 which are extensions of the inner wall surfaces of the blind recess 79, are in contact with the wall surface of the bore 33 in the door 22, their perfect fit constituting an additional means of centering. Since the bores 73 and 77, and 72 and 82 respectively align with each other it is possible to insert from the side of the shaped part 27 the fixing screws 39 which cause the shaped part 27 and the cover plate 36 to be firmly pressed against the respective outer sides 28, 38, of the glass door 22. The circumferential outlines of the shaped part 27 and the cover plate 36 are essentially alike, corresponding approximately to elongate ovals with roughly the same sidths and lengths, and cut through, in approximately the transverse median plane.

According to FIGS. 1 and 2, the arresting finger 26 is shaped roughly as a head, and it includes on the side which, in the assembled position projects over the shaped part 27, a locking recess 87 which merges at its lower end into a nose 88 with a transverse bore 89 chamfered at either end and aligning, in the assembled position, with the transverse bores 54 of the projections 53 to accommodate part of the swivel pin 56. The arresting finger 26, which appears rectangular when looked at from the front or back, extends at its rear side, which is remote from the nose 88, inwards at a given angle and includes an integral stopping element 91 at its end whch is diagonally opposite the locking recess 87. It can be seen, especially from FIG. 2, that this stopping element 91, loaded by compression spring 58, rests against a counter stop 92 on the shaped part 27 when it does not engage with the arresting finger, and slightly extends beyond the rectangular section of the blind recess 57 in the hinge body 31, which accommodates the arresting finger 26. The other end of the compression spring 58 supports itself on the bottom of a blind-hole 93 in the finger 26, which extends from the end portion thereof which is provided with the stopping element 91, to about the level of the locking recess 87, and, in the region beneath the nose 88, has the shape of a semi-circular bore which is open towards the front.

Figure 13:
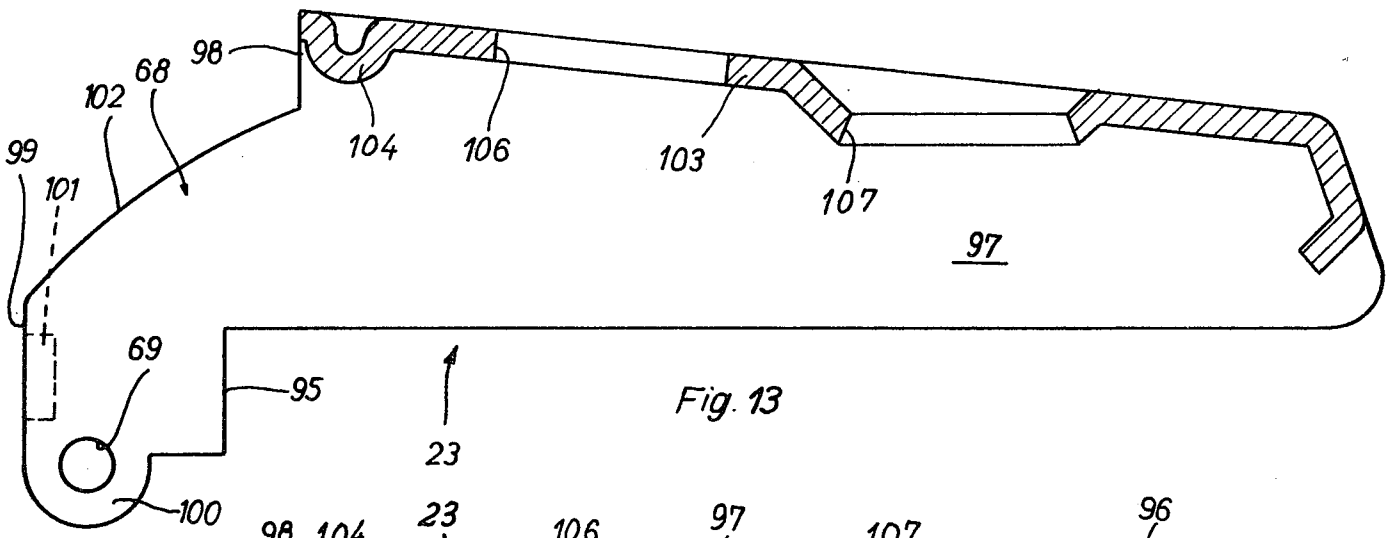
FIG. 13 is a longitudinal section through the connecting member along the line 13—13 in FIG. 12.
Figure 12:
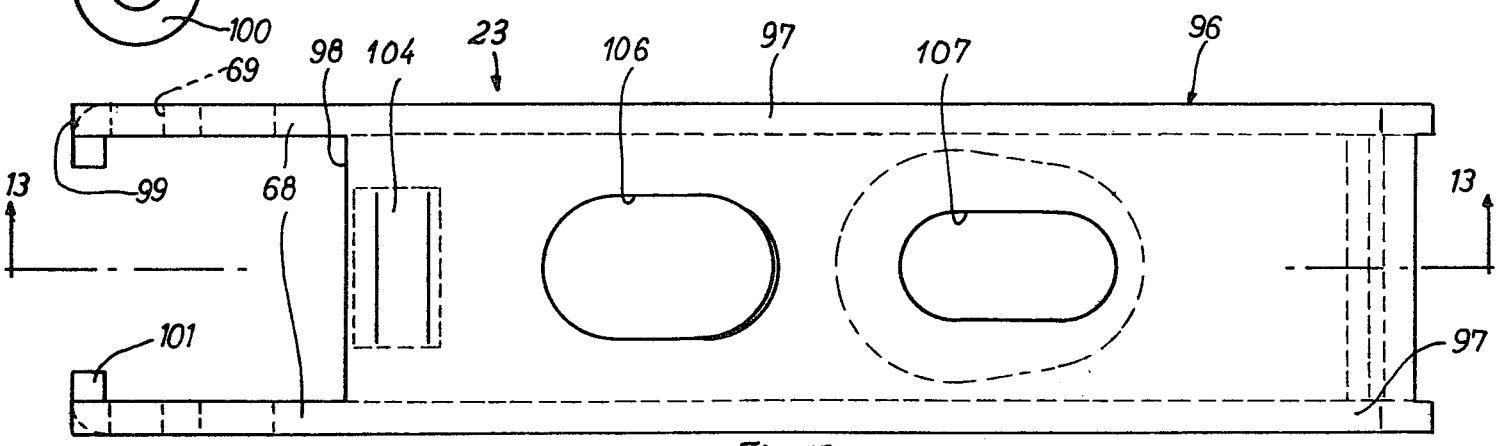
FIG. 12 is a plan view of the connecting member of the hinge.

According to FIGS. 12 and 13, the connecting member 23 comprises a unit 96 of elongate U-section whose side walls 97 extend into parallel, articulated wall sections or projections 68, defining a projecting edge 95 and an upper stopping edge 98, and incorporating lugs 100 to accommodate the swivel pin 67 in transverse bores 69. Two front edges 99 of the articulated wall sections are bent inwards through 90°, the articulated wall sections 68 extending along a curve 102 in the zone between the front edges 99 and the stopping edges 98. The web 103 connecting the two side walls 97, which taper towards the free end, comprises at the end adjacent to the stopping edge 98 a bulge 104 which extends across part of the width and projects inwards between the side walls 97. There are, moreover, two longitudinal holes 106, 107 in the upper part 103, the edges of the hole 107 being pressed inwards in such a manner that the plane of the longitudinal hole 107 extends parallel with the lower edges of the side walls 97. These longitudinal holes 106 and 107 enable fastening elements such as screws to be passed through in order to fasten the connecting member 23 to the fixed part 24 of the hinge. At its free end the upper part 103 is bent inwards to embrace the fixed part 24 of the hinge from the rear. With the hinge 20 in the position shown in FIG. 1, the bulge 104 is in conjugate contact with the locking recess 87 of the arresting finger 26, and the stopping edge 98 rests against the shaped part 27 at the end of the longitudinal slots 61, whereby the curved edge 102 rests against the curved portion 62 of the shaped part 27, which has approximately the same form. In the position shown in FIG. 2, lugs or tie blocks 101 can butt against the bearing faces 64 of the undercuts 63 in the longitudinal slots 61.

The cover elements shown in FIGS. 14 to 19 are suitable for the covering plate 36 and, in a modified form, also for the shaped part 27. The cover elements 41 shown in FIGS. 14, 15*a* and 15*b*, for the cover plate 36 has an approximately square base and is pot-shaped, the clear height of the four side walls corresponding approximately to the height of the cover plate 36; it is forced onto the latter. To fit over the articulated side wall sections 68 of the connecting member 23, the cover element 41 has to be provided with two parallel slots 108. In order to use the cover element 41 with the shaped part 27, these slots 108 have to be extended as indicated by the dotted lines, and there has to be provided in the base an approximately rectangular opening 109, to accommodate the arresting finger 26 and give it the necessary freedom of movement.

The cover element 42 presented in FIGS. 16 and 17 serves for the protection of the covering plate 36, and has an identical base. It has an angular end section and comprises two side lugs or ties 111 engaging with recesses in the cover plate 36 (FIG. 4), the angular form of this end section corresponding to the depth of the cover plate 36. At its curved end, the cover element 42 has an additional lug or tie 112 in the region of its longitudinal median plane which, according to FIG. 17, is bent by 90° to be inserted into the slot 78 of the cover plate 36, for fixing.

Similarly, the cover element 43 according to FIGS. 18 and 19 is suitable for the cover plate 36 and after modifications corresponding to those of the covering element 41, also for the shaped part 27. Its base has the form of an elongate rectangle and it therefore covers a greater area in front of, and behind, the cover plate 36. The cover element 43 is likewise pot-shaped and is clamped on to the cover plate 36, or rather pressed over the latter.

Summarising, the hinge 20 comprises a small number of components which are manufactured and assembled in a simple manner. For example, the shaped part 27 together with the hinge body 31 and the pin 32, and also the cover plate 36 and the arresting finger 26, can be manufactured from plastics materials without requiring complex moulds, since all parts are suitable for injection or for compression moulding. Similarly, the connecting member 23 is simple to manufacture; it can for example be formed and punched out of metal. The swivel pins 56 and 67 are components made of commercially available circular rods and also the compression spring 58 is available on the market. The articulated assembly of the arresting finger 26 and the connecting member 23 with the shaped part 27 does not call for particular dexterity, the swivel pins 56, 67 being simply pushed into the device from one side of the shaped part 27. No additional assembly operations are required, because all other fixing means, stops, catches, etc., are part of the corresponding structural elements. This means that a hinge has been provided whose design is extremely simple.

Although our invention has been illustrated and described with reference to the preferred embodiments thereof, we wish to have it understood that it is in no way limited to the details of such embodiments, but is capable of numerous modifications within the scope of the appended claims.

Having thus fully disclosed our invention, what we claim is:

1. A hinge for mounting a structure such as a frameless glass door or the like on a fixture, said hinge comprising a substantially part-cylindrical body portion which is arranged to be inserted in an opening in the structure, the opening having a cross-section defined by a chord so as to provide, on the cylindrical surface of the body portion, a planar portion which, when the hinge is assembled on the structure is aligned with a longitudinal edge of the structure, said hinge including a pin extending parallel to the body portion and being spaced therefrom such that its axis lies on an imaginary line which passes through the axis of the body portion normal to said chord, to the side of the axis of the body portion remote from said chord, said pin being arranged to be inserted in a bore in the structure, and a connecting member hinged on the body portion and adapted to be mounted on the fixture.

2. A hinge according to claim 1, wherein the length of said imaginary line extending between said chord and the periphery of the body portion is between two thirds and three quarters of the diameter of the cylindrical part of the body portion.

3. A hinge according to claim 1, comprising a cover plate connectible with the body portion and the pin.

4. A hinge according to claim 3, wherein the axial length of the body portion is so arranged as to exceed the thickness of the structure, such that the body portion, when inserted in the opening in the structure from one face of the latter, extends beyond the opposed face the cover plate being provided with a recess within which the body portion fits snugly, and at least two projections in said recess extending beyond a surface of the cover plate which is arranged to bear against a surface of the body portion.

5. A hinge according to claim 3, wherein the axial length of the pin is so arranged as to be less than the thickness of the structure, the cover plate being provided with a further projection engageable with the pin in said bore.

6. A hinge according to claim 5, wherein each of the projections has a blind bore, which, in the assembled position, aligns with a corresponding through bore in the body portion and the pin.

7. A hinge according to claim 6, wherein the body portion and the pin are formed as a single component.

8. A hinge according to claim 7, wherein the single component is formed of a plastics material.

9. A hinge according to claim 7, wherein a cover element is provided for the single component.

10. A hinge according to claim 7, wherein a cover element is provided for the cover plate.

11. A hinge according to claim 9, wherein the cover element is formed of metal.

12. A hinge according to claim 9, wherein the cover element is of square configuration.

13. A hinge according to claim 9, wherein the cover element is of rectangular configuration.

14. A hinge according to claim 12, wherein the cover element is a press fit on the associated component or plate member.

15. A hinge according to claim 9, wherein the cover element is of substantially semi-circular configuration.

16. A hinge according to claim 15, wherein the cover element has angled lugs, at least one of which clips onto the associated component or plate member, and one of which engages in a slot provided in the associated component or plate member.

17. A hinge according to claim 16, wherein the body portion has at least one slot extending inwardly thereof from, and normal to, the planar portion, the slot accommodating a respective portion of the connecting member which is mounted on a swivel pin located in the body portion.

18. A hinge according to claim 17, wherein the slot has an undercut defining a shoulder against which a lug on the respective portion of the connecting member can engage.

19. A hinge for mounting a structure on a fixture, comprising a first member for mounting on the structure, a connecting member hinged on said first member and adapted to be mounted on the fixture, and an arresting member rotatably mounted on said first member and engageable with a locking portion of said connecting member to retain the latter in one position relative to said first member, said arresting member being biased into a position for locking engagement with said locking portion, and being located on said first member between two parts which provide a bearing for a pin on which the arresting member is mounted.

20. A hinge according to claim 19, wherein said parts of said first member define a recess wherein the arresting member is located, the latter having a blind bore which opens into the recess, and there is provided a compression spring engaging at one end in said bore and at its other end against the base of the recess so as to bias the arresting member into said position for locking engagement.

* * * * *